US006547592B2

(12) United States Patent
Boillot

(10) Patent No.: US 6,547,592 B2
(45) Date of Patent: Apr. 15, 2003

(54) COAXIAL ELECTRICAL CONNECTOR ELEMENT ALSO PROVIDING A SWITCHING FUNCTION

(75) Inventor: Laurent Boillot, Voiron (FR)

(73) Assignee: Radiall, Rosny-sous-Bois (FR)

( * ) Notice: Subject to any disclaimer, the term of this patent is extended or adjusted under 35 U.S.C. 154(b) by 0 days.

(21) Appl. No.: 09/913,755

(22) PCT Filed: Jan. 8, 2001

(86) PCT No.: PCT/FR01/00041

§ 371 (c)(1),
(2), (4) Date: Jan. 2, 2002

(87) PCT Pub. No.: WO01/50549

PCT Pub. Date: Jul. 12, 2001

(65) Prior Publication Data

US 2002/0160657 A1 Oct. 31, 2002

(30) Foreign Application Priority Data

Jan. 6, 2000 (FR) ..... 00 00131

(51) Int. Cl.[7] ..... H01R 29/00
(52) U.S. Cl. ..... 439/578; 439/188
(58) Field of Search ..... 439/188, 578, 439/581, 583, 944; 200/51.1

(56) References Cited

U.S. PATENT DOCUMENTS 5,562,464 A 10/1996 Lecourtois ..... 439/188
5,921,793 A 7/1999 Phillips ..... 439/188
6,152,750 A * 11/2000 Huguenet et al. ..... 439/188

FOREIGN PATENT DOCUMENTS

EP 0 685 911 A 12/1995

* cited by examiner

*Primary Examiner*—Renee Luebke
*Assistant Examiner*—Alexander Gilman
(74) *Attorney, Agent, or Firm*—Schweitzer Cornman Gross & Bondell LLP

(57) ABSTRACT

A coaxial electrical connector element, providing a switching function, comprises a central conductor, an external conducting body forming a ground contact, a contact piece, and a conducting socket. The conducting socket can move axially about the central conductor, between a first position, in which it simultaneously bears against the central conductor and the contact piece, and a second position, in which it is spaced from the contact piece. A return member is provided for urging the conducting socket into its first position. The return member consists of an elastically deformable tubular piece (11) engaged around the central conductor (3). The tubular piece is place in the conducting body (1) so as to be held therein by a cylindrical end part (12) while still being able to deform radially owing to axial displacement of the conducting socket (7, 7') during mating with a complementary connector element (C). The socket is designed to push the free end (14) of said tubular piece (11) axially backward.

4 Claims, 3 Drawing Sheets

COAXIAL ELECTRICAL CONNECTOR ELEMENT ALSO PROVIDING A SWITCHING FUNCTION

The present invention relates to a coaxial electrical connector element also providing a switching function, allowing one electrical line to be switched to another electrical line.

Many constructions of such electrical connector elements, especially of the miniature type, are already known for microwave applications. A complementary connector element, the fitting of which into the connector element provides the switching function, may for example be a connector element which diverts the microwave signal from an internal antenna to an external antenna.

Known connector elements for providing a switching function comprise a central conductor, an external conducting body forming a ground contact, a contact piece and a conducting socket which can move axially, about the central conductor, between a first position, in which it bears against the central conductor on the one hand and the contact part on the other, and a second position, in which it is away from the contact piece, a return member being provided for urging the conducting socket into its first position.

The connector element is designed in such a way that, during mating with a complementary connector element, the movable conducting socket, which is normally in its first position, is pushed back into its second position and carries out the switching operation by bringing the central conductor of the connector element into electrical contact with the central conductor of the complementary connector element.

The filing company has already described in FR-A-2 720 555 a coaxial connector element of this type, in which the return member consists of a helical spring bearing, on the one hand, against an insulating body serving to keep the inner conductor in place and, on the other hand, against a bearing surface of the movable conducting socket.

For certain spring lengths, it has been found in practice that the spring, in direct contact with the movable conducting socket, acts as an internal resonator, preventing correct operation within the useful frequency range in microwave applications.

To reduce the insertion losses, it has been proposed to fit an insulating washer between the spring and the conducting socket This washer has the drawback of entailing an additional cost because of the increase in complexity of the manufacture.

It has also been proposed to electrically connect the spring constituting the elastic return member at both its ends to the central contact, the spring being in this case held in place between two shoulders of the central conductor.

This solution has the advantage of being less expensive than that using an insulating washer, but it merely mitigates the internal resonance problem by shifting the resonance to higher frequencies.

The object of the present invention is to provide a coaxial electrical connector element also providing a switching function which, while being of simple, robust and inexpensive design, avoids the above-mentioned drawbacks of the known connector elements, while still exhibiting excellent microwave behavior especially by eliminating any internal resonance.

The connector element according to the present invention is essentially characterized in that the return member consists of an elastically deformable tubular piece engaged around the central conductor, said piece being placed in the conducting body so as to be held therein by a cylindrical end part while still being able to flex elastically, by deforming radially owing to the action of the displacement of the axially movable conducting socket during mating with a complementary connector element, said socket being designed to push the free end of said tubular piece axially backward.

Preferably, the elastically deformable piece is made of an elastomer, particularly a silicon elastomer, preferably having a Shore hardness of between 50 and 80. Other materials may also be envisioned, especially polymeric materials, provided that they have comparable strength properties at the soldering temperature, maintaining elasticity properties over the entire operating range in terms of temperature and compression, and having a low compression set.

It will be understood that the elastically deformable piece of the present invention makes it possible to provide three functions which, in the known connector elements, were provided by different elements, namely the role of mechanically holding the central conductor in position in the conductor body, which role was previously fulfilled by an insulating body, the dielectric role for transmitting the microwave signal, previously fulfilled by the insulating body, and the role of the actual return member, intended to make the axially movable socket come into contact with the contact piece when the complementary connector element is not mated.

The axially movable socket includes, in a first embodiment, a collar against which the free end of the elastically deformable piece butts, the socket having a sleeve part engaged in the end of the elastically deformable piece, allowing it to slide along the central conductor.

In a second embodiment, the movable socket consists of a disk-shaped piece having a central bore, having a diameter very slightly greater than the diameter of the central conductor in order to allow sliding along the central conductor and electrical contact with the latter when the socket is pushed back owing to the effect of the bearing of the deformed end of the elastically deformable piece.

The latter is, in a cylindrical part on the other side from its free end, drilled with a hole for passage of the inner conductor, this hole possibly being produced during molding or being pierced by the tip of the central conductor itself during manufacture of the connector element.

Further advantages and characteristics of the invention will become apparent on reading the following description of illustrative examples, which are in no way limiting, with reference to the appended drawing in which.

Figure 1:
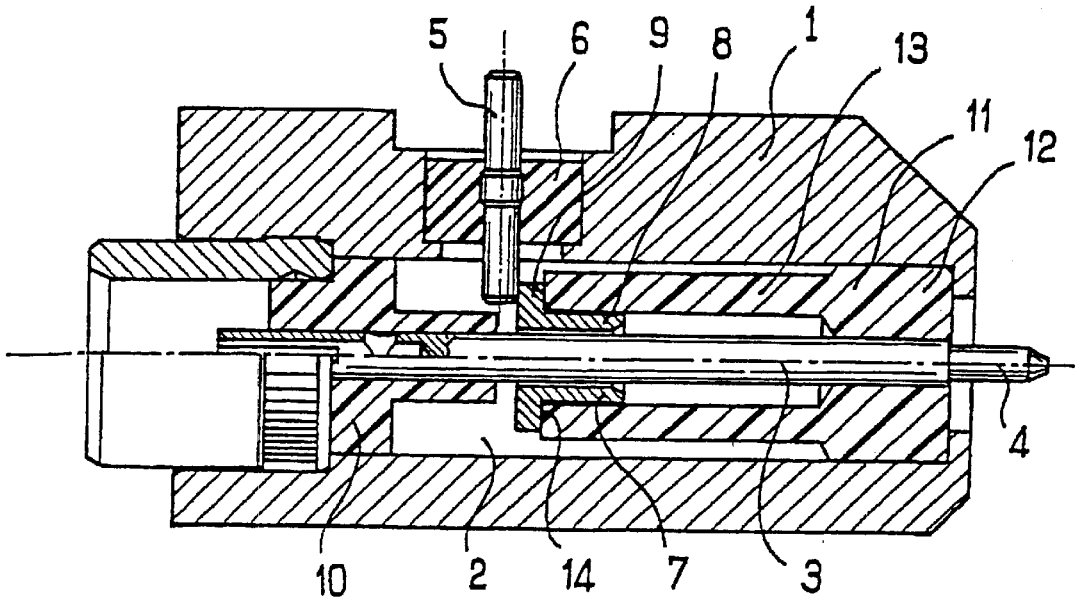
FIG. 1 is a sectional view of a coaxial connector element according to the invention.
Figure 2:
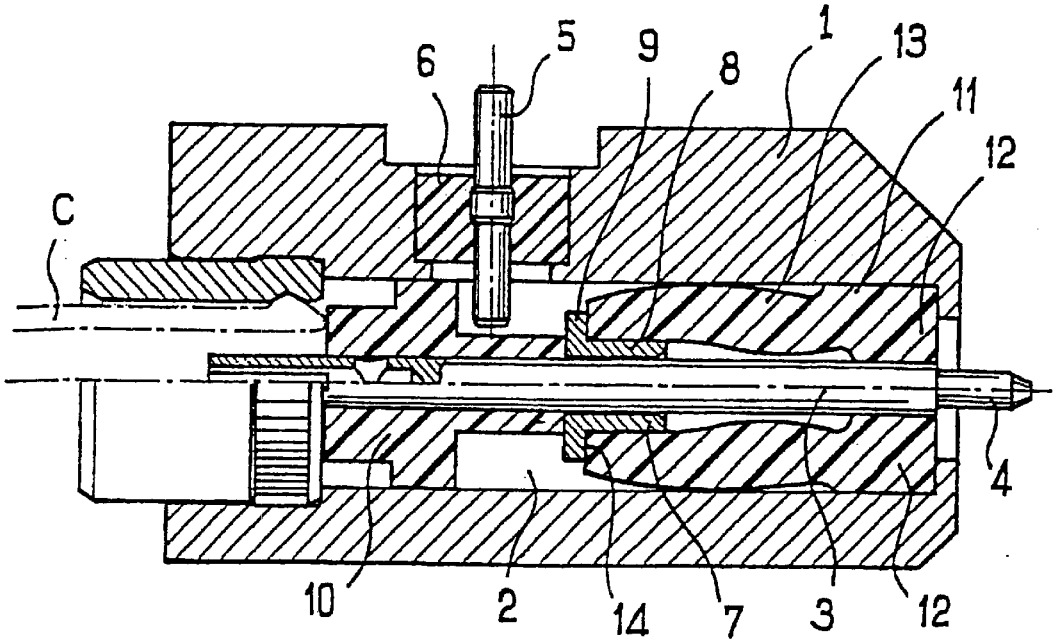
FIG. 2 is a view similar to FIG. 1 of the connector element in the switched position.

Reference will firstly be made to FIGS. 1 and 2, which illustrate a coaxial connector element, according to the invention, of the miniature type intended for microwave applications.

The connector element comprises an external conducting body 1, of rectangular cross section in the illustrative example, having an internal bore 2, along the inside of which lies a central conductor 3 terminated at its end by a tip 4 which projects axially from the body 1 and defines a first signal transfer line.

A second signal transfer line is defined by a cylindrical contact piece 5 extending radially from said body 1 in which an insulator 6 is fitted and immobilized. The contact piece 5 runs into the bore 2 of the body 1.

A third signal transfer line is defined by the central conductor of a complementary connector element C, not shown in detail, but whose outer ground conductor has been shown schematically in FIG. 2 by the broken line.

In the normal, non-switched, operating position, as seen in FIG. 1, an electrical link is established between the first and second lines defined above by electrical contact between the central conductor 3 and the contact piece 5. This electrical contact is provided by means of a conducting socket 7 mounted so as to move axially along the central conductor 3, with a certain clearance as may be seen in the drawing, in order to allow the socket 7 to switch when it bears on the contact piece in order to bring it into contact with the central conductor 3.

In the embodiment shown in FIGS. 1 and 2, the conducting socket 7 has a sleeve part 8 of internal diameter slightly greater than the external diameter of the central conductor 3, extended by a part in the form of a collar 9.

As will be understood on examining FIGS. 1 and 2, the displacement of the movable socket 7 (from the left to the right in the drawing) is caused by a bearing body 10 made of an insulating material bearing on the outer face of the collar 9 of the socket, said bearing body 10 being guided internally along the central conductor 3 and externally along the wall of the bore 2 of the body 1.

Figure 3:
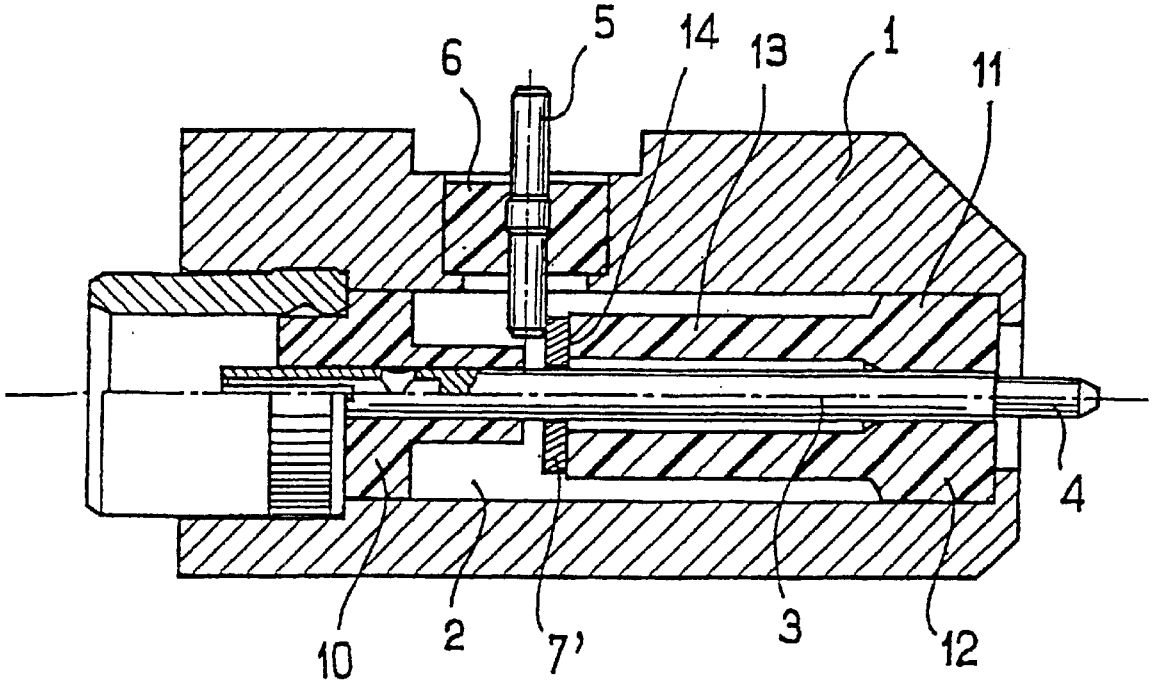
FIG. 3 is a view similar to FIG. 1 of an alternative embodiment of a connector element according to the invention.

The embodiment in FIG. 3 differs from that in FIG. 1 by the structure of the movable socket. In the second embodiment, the socket consists of a disk-shaped piece 7' having a central bore of diameter very slightly greater than the diameter of the central conductor 3.

In both embodiments illustrated, the connector element according to the invention includes a tubular piece 11 having a cylindrical end part 12 serving for holding the piece 11 in place in the bore 2 of the body, the external diameter of the cylindrical part 12 being approximately equal to the internal diameter of the bore, it being possible for them to be fitted together either with a slight clearance or with a close fit, taking into account the elasticity properties of the constituent material of the piece 11.

The front part 13 of the piece 11 has an external diameter less than the diameter of the cylindrical part 12 so that, as may be seen in FIGS. 1 and 3 in the non-switched position, the part 13 is not in contact with the wall of the bore 2 of the body 1.

The parts 12 and 13 of the piece 11 are joined by a conical transition region, thereby facilitating the demolding of the piece.

The free end 14 of the part 13 bears against the movable socket 7, or alternatively 7', and during displacement of the socket, towards the right in the drawing, from the position in FIGS. 1 and 3 owing to the action of the insertion of the complementary connector element C, the piece 11 in its part 13 undergoes an approximately barrel-shaped deformation, as may be seen in FIG. 2.

When the complementary connector element C is unmated, the piece 11 resumes its configuration in FIGS. 1 and 3, keeping the socket 7, 7' bearing against the contact piece 5.

The various components of the connector element according to the invention are defined and dimensioned in such a way that, in the non-switched position (FIGS. 1 and 3), the force exerted by the piece 12 on the movable socket 7, 7', and therefore on the contact piece 5, is greater than 0.4 N and in such a way that, in the switched position (FIG. 2), this force on the bearing body 10 is less than 3 N.

Figure 4A:
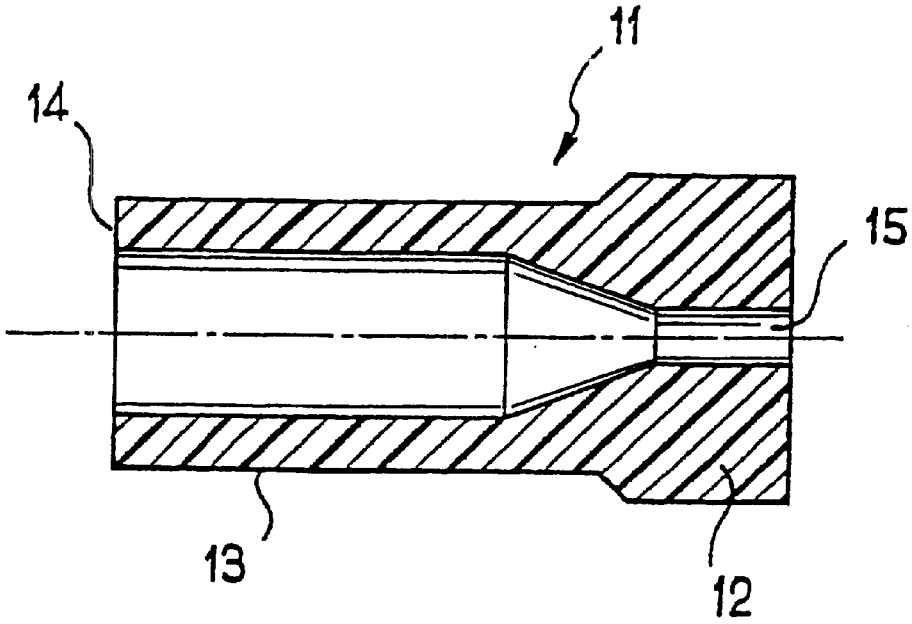
FIGS. 4*a* and 4*b* illustrate two possible embodiments of the elastically deformable piece of the connector element according to the invention.
Figure 4B:
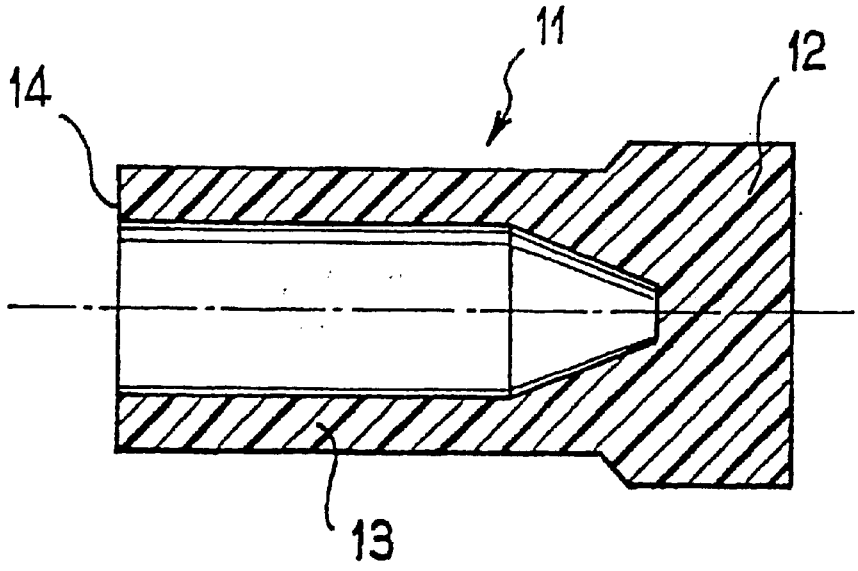

In order for the central conductor 3 to pass, the cylindrical part 12 of the elastically deformable piece 11 must have a central hole 15 which can be produced during molding (the variant in FIG. 4*a*) or which is obtained by being pierced by the tip-shaped end 4 of the central conductor 3, during manufacture of the connector element, the piece 11 molded as one piece having the configuration illustrated in FIG. 4*b*.

Although the invention has been described in connection with particular embodiments, it is in no way limited thereby and it is possible to provide it with different variants and modifications without in any way departing either from the scope or the spirit thereof.

What is claimed is:

1. A coaxial electrical connector element for providing a switching function, comprising a central conductor, an external conducting body forming a ground contact, a contact piece and a conducting socket which can move axially, about the central conductor, between a first position in which it bears against the central conductor on the one hand and the contact part on the other, and a second position, in which it is away from the contact piece, a return member being provided for urging the conducting socket into its first position, characterized in that the return member consists of an elastically deformable tubular piece (11) engaged around the central conductor (3), said tubular piece being placed in the conducting body (1) so as to be held therein by a cylindrical end part (12) while still being able to flex elastically, by deforming radially owing to the action of the displacement of the axially movable conducting socket (7; 7') during mating with a complementary connector element (C), said socket being designed to push the free end (14) of said tubular piece (11) axially backward.

2. The connector element as claimed in claim 1, characterized in that the elastically deformable piece (11) is made of an elastomer, particularly a silicon elastomer.

3. The connector element as claimed in claim 1, characterized in that the axially movable socket (7) includes a collar (9) against which the free end (14) of the elastically deformable piece (11) butts, the socket having a sleeve part (8) engaged in the end of said elastically deformable piece, allowing it to slide along the central conductor (3).

4. The connector element as claimed in claim 1, characterized in that the movable socket (7') consists of a disk-shaped piece having a central bore.

* * * * *